US006450359B1

(12) United States Patent
Chang et al.

(10) Patent No.: US 6,450,359 B1
(45) Date of Patent: Sep. 17, 2002

(54) SANITARY BEVERAGE CAN LID

(76) Inventors: Charles Chang, 55 Westview Rd., Wayne, NJ (US) 07470; Lucy Chang, 55 Westview Rd., Wayne, NJ (US) 07470

( * ) Notice: Subject to any disclaimer, the term of this patent is extended or adjusted under 35 U.S.C. 154(b) by 0 days.

(21) Appl. No.: 09/695,450

(22) Filed: Oct. 24, 2000

Related U.S. Application Data

(63) Continuation-in-part of application No. 09/312,836, filed on May 17, 1999, and a continuation-in-part of application No. 09/312,837, filed on May 17, 1999, and a continuation-in-part of application No. 09/185,458, filed on Nov. 13, 1998, and a continuation-in-part of application No. 09/070,056, filed on Apr. 30, 1998, now Pat. No. 5,934,497, and a continuation-in-part of application No. 09/009,381, filed on Jan. 20, 1998, now abandoned.

(51) Int. Cl.[7] ..... B65D 17/34
(52) U.S. Cl. ..... 220/269; 220/268; 220/906
(58) Field of Search ..... 220/268, 269, 220/270, 906

(56) References Cited

U.S. PATENT DOCUMENTS 2,124,823 A * 7/1938 Kronquest ..... 106/270
2,426,550 A * 8/1947 Coyle ..... 220/619
2,547,059 A * 4/1951 Taylor et al. ..... 220/906
3,858,754 A * 1/1975 Patarini et al. ..... 220/269
4,247,014 A * 1/1981 Walz ..... 220/269
4,262,815 A * 4/1981 Klein ..... 220/269
4,266,688 A * 5/1981 Reid ..... 220/269
4,480,763 A * 11/1984 Schneider ..... 220/269

* cited by examiner

*Primary Examiner*—Stephen K. Cronin
(74) *Attorney, Agent, or Firm*—Richard A. Joel, Esq.

(57) ABSTRACT

The invention comprises a soda can lid which forms a seal with one's upper lip during thereby preventing spillage and eliminating residue. The raised platform area on the lid is connected to the pull-tab area with outwardly sloping walls designed to engage the lips. The platform area is slightly higher than the depth of a circular peripheral groove ranging up to slightly higher than the rim. The lid may also include seal portions extending upwardly from the platform on both sides of the depressed pull-tab area. The invention may be employed on lids either with or without a peripheral groove. Another feature of the invention is a pull-tab with an arch handle and special puncture tip for easier more comfortable use by consumers.

13 Claims, 5 Drawing Sheets

FIG. 9
(PRIOR ART)
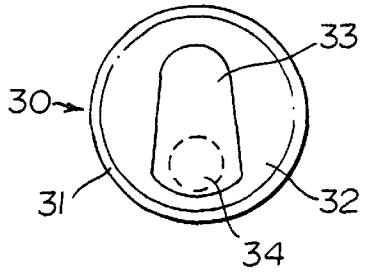
FIG.10
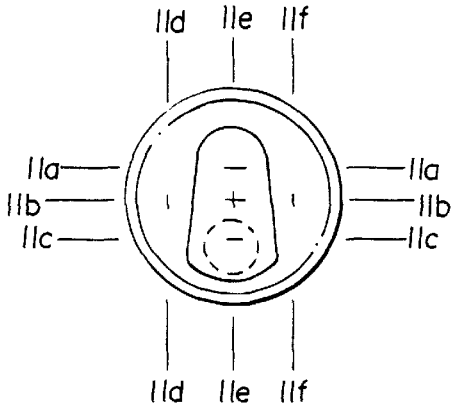
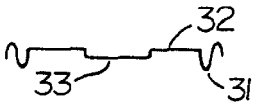
FIG.11a
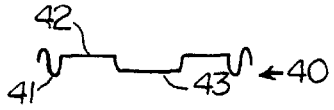
FIG.12a
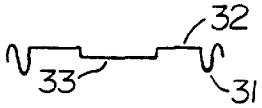
FIG.11b
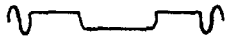
FIG.12b
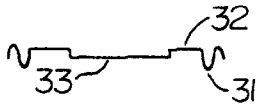
FIG.11c
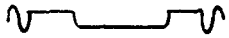
FIG.12c
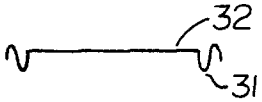
FIG.11d
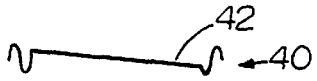
FIG.12d
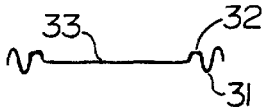
FIG.11e
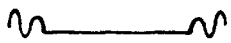
FIG.12e
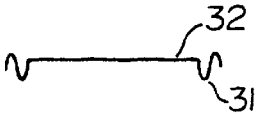
FIG.11f
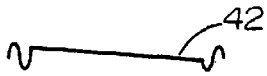
FIG.12f

SANITARY BEVERAGE CAN LID

CROSS-REFERENCE TO RELATED APPLICATIONS

This application is a continuation in part of the following applications: Ser. No. 09/009,381 filed Jan. 20, 1998, now abandoned; Ser. No. 09/070,056 filed Apr. 30, 1998, issued under U.S. Pat. No. 5,934,497 on Aug. 10, 1999; Ser. No. 09/185,458 filed Nov. 13, 1998; Ser. No. 09/312,836, filed May 17, 1999; and, Ser. No. 09/312,837, filed May 17, 1999.

STATEMENT REGARDING FEDERALLY SPONSORED RESEARCH OR DEVELOPMENT

NOT APPLICABLE

REFERENCE TO A MICROFICHE APPENDIX

NOT APPLICABLE.

BACKGROUND OF THE INVENTION

1. Field of the Invention

This invention relates to beverage cans for soft drinks, beer, juices and the like, with pull off tabs on the upper lid thereof In particular, the invention is concerned with a sanitary lid wherein the individual drinking directly from the can does not spill the fluid due to the fact that the lid affects a seal with one's upper lip. The invention discloses a lid design, which proposes a raised platform area adjacent the pull-tab area with sloping wall surfaces therebetween to affect a seal during drinking. The invention also eliminates residue on the lid and permits easy cleaning of the lid. An improved pull-tab makes opening easier.

2. Description of the Related Art Including Information Disclosed Under 37 CFR §§1.97–1.98

This invention is designed to provide a flat end sanitary beverage can lid which eliminates problems associated with can lids of the prior art. The prior art is rather voluminous but it is not believed that the specific invention disclosed herein is anticipated by any of the prior art patents.

In the prior art, U.S. Pat. No. 4,262,815 to Klein, discloses a conical end can with an opening tab at the cone apex, which is merely designed for nesting purposes. This patent discloses a rather complicated conical can end with a different type pull-tab. Klein is not concerned with applicant's flat end can. Further, a critical problem with Klein's conical can is the fact that the weight of stacked-up cases will be borne by the conical neck in warehousing and shipping. This requires a very thick and strong material, such as steel, for the conical neck. Also, the design introduces stress to the crimped seal between the neck and the can body whereas in the present invention the cans are stacked on the crimped rim which eliminates the necessity of extra strong lid material and permits the use of recyclable aluminum lids. In contrast to Klein, less space is required in shipping and storage.

U.S. Pat. Nos. 5,108,003 and 5,119,955 to Granofsky disclose the use of a complimentary cover for a beverage can in order to permit sanitary drinking from a can.

U.S. Pat. No. 4,895,270 to Main discloses a sanitary cover for a pop-top beverage container comprising an elastic membrane extending over the top and axially along a portion of the sidewall of the container.

In another type of container, U.S. Pat. No. 3,946,895 to Pugh discloses a container lid with a tear closure and a straw. Another interesting but different proposal for a sanitary drinking can is disclosed in U.S. Pat. No. 4,114,778 to O'Neal, which provides an interiorally attached sanitary drinking spout within. the container.

U.S. Pat. No. 4,078,695 to Potts is also of interest but fails to disclose certain features of applicants' design such as a raised platform having a substantially V-shaped configuration and a groove extending partially about the rim.

Also of interest are U.S. Pat. No. 2,547,059, 4,078,695, 4,407,425; 4,047,634; 3,300,081; 4,318,493; and, 5,415, 313.

Applicants pending applications Ser. No. 09/070,056 and Ser. No. 09/009,381 both deal with designs to clean or avoid the deep groove about the rim edge, which accumulates debris. The solution proposed by applicants in the pending applications involved, inter alia, unique double rim designs. Also of interest is applicant's issued U.S. Pat. No. 5,813, 561.

The foregoing prior art patents disclose various can lids and means for providing a sanitary can opening for drinking directly from a container. To improve the can design and prevent spillage applicant proposes in this application, a can which forms a seal with one's upper lip and a unique pull tab which is easier and more comfortable to use. The unique concepts proposed by applicants herein are nowhere shown or suggested in these particular references.

SUMMARY OF THE INVENTION

The present invention relates to beverage cans and in particular to a new and improved flat end sanitary drinking can, which creates a seal with one's upper, lip during drinking.

The invention comprises a flat end beverage can lid including a flat pull tab area which extends to the periphery of the lid and a raised platform on both sides of the pull-tab area having a substantially V-shaped configuration. The pull-tab area is connected to the raised platform with outwardly sloping walls. The platform area is slightly higher than the depth of a circular peripheral groove, if one exists, and ranges upwardly to a height slightly higher than the rim. The lid may also include seal portions extending upwardly from the platform on both sides of the lower pull-tab area. The invention provides a seal with one's upper lip against the walls of the upper platform to avoid spillage when drinking directly from the can.

An object of this invention is to provide a new and improved lid for a flat end beverage can wherein the lid platform is raised above the pull-tab area to form a seal during drinking.

Another object of this invention is to provide a new and improved flat end beverage can lid wherein the pull tab area extends to the periphery of the can and includes upwardly extending walls joining the pull tab area with the raised platform area to form a seal to eliminate dripping during, drinking from the can.

Another object of this invention is to provide a new and improved soda can lid which affects a seal during drinking and can be used either with or without a peripheral groove.

Yet, another object of this invention is to provide a new and improved beverage can lid to confine the liquid within the pouring spout area and allow the liquid to drain back into the can keeping the lid free of residual liquid.

Another object of this invention is to provide an easy access area on a new and improved can lid which is near the pouring spout area for easy cleaning of debris accumulated on the lid.

A further object of this invention is to provide a new and improved flat end beverage can lid wherein the platform area is slightly higher than the groove depth and extends on both sides of the pull tab area to the periphery to create a seal during drinking.

A still further object of this invention is to provide a new and improved flat end beverage can having an "easy clean" feature wherein the peripheral groove is eliminated over all or part of the lid, a drain back feature wherein the pull tab area slopes towards the opening and a seal created with one's upper lip and the raised platform to eliminate spillage during drinking.

A more specific object of this invention is to provide a new and improved flat end beverage can lid to create a seal with an upper lip during drinking from the can wherein one's upper lip is placed over the pull tab area and against the raised platform joining the platform to the pull tab area and walk to form a seal.

Another object of this invention is to provide a new and improved flat end beverage cain lid wherein the unique pull-tab includes an arch handle and a special puncture tip for easier and more comfortable use by consumers.

BRIEF DESCRIPTION OF THE DRAWINGS

The above and other objects and advantages of the invention may be more clearly shown when viewed in conjunction with the accompanying drawings wherein:

FIG. 9 is a top view of a prior art lid,

FIG. 10 is a top view of FIG. 9 with a plurality of planes taken therethrough, FIGS. 11*a*–11*f* are cross-sectional views taken along the lines in FIG. 10; showing a typical can lid;

FIGS. 12*a*–12*f* are cross-sectional view taken along the lines of 11*a*–11*f* in FIG. 10 but showing a new type can lid for comparison with FIG. 11*a*–11*f;*

DETAILED DESCRIPTION OF THE INVENTION

Figure 1:
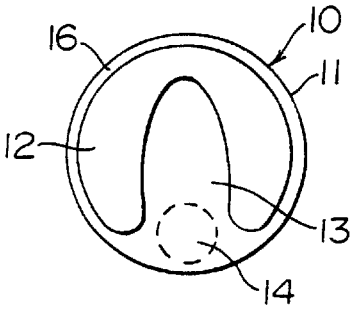
FIG. 1 is a top view of a beverage can lid illustrating the invention.

Referring now to the drawings, the invention comprises a unique sanitary can lid 10 having means to effect a seal with the user's upper lip during drinking to eliminate spillage. As shown in FIG. 1, the lid 10 includes an outer rim 11, a raised platform portion 12 and a pull-tab area 13 with aperture 14. The raised area forms a depressed groove 16 with the rim 11, which terminates in the pull-tab area 13. In drinking from the can, the user places his upper lip over the aperture 14 and against the raised portion 12, which is substantially V-shaped, and narrows to the rear of the "V".

Figure 2:
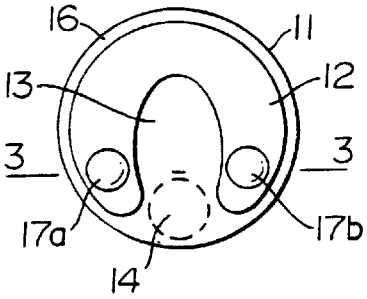
FIG. 2 is a top view of the invention with raised portions on the lid platform to facilitate a seal.
Figure 3:
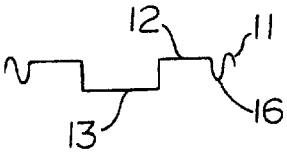
FIG. 3 is a cross-sectional view taken along the line 3—3 of FIG. 2.
Figure 4:
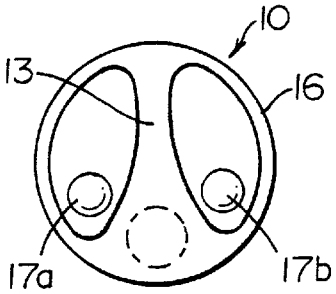
FIG. 4 is a top view of an alternate embodiment of the invention without a peripheral groove in the vicinity of the pull-tab.
Figure 6:
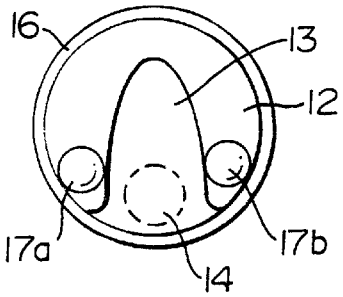
FIG. 6 is a top view of an alternate embodiment of the invention with raised portions extending upwardly from the platform.

In FIGS. 2 and 3, the raised platform portion 12 is substantially U-shaped. In FIG. 6, the platform is also U-shaped but, as in FIG. 7, the groove 16 extends completely around the periphery of the lid 10. This is in contrast to the "easy-clean" design of FIG. 1 where the groove 16 ends at the pull-tab area 13 and debris may be readily wiped off the pull-tab area 13. The raised platform portion 12 and with projections 17*a*–17*b* may be slightly higher than the groove depth up to slightly higher than the rim 11. Normally, it will not extend above the rim 11. The height difference between the platform 12 and the pull-tab area 13 is slightly below the distance of the raised portion 12 to the groove 16. FIG. 4 depicts an embodiment wherein the pull-tab area 13 extends completely across the lid 10.

Figure 5:
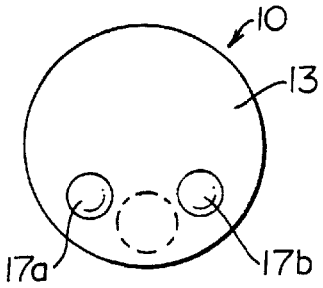
FIG. 5 is a top view of an alternate embodiment of the invention showing a uniform lid surface with raised portions on opposite sides of the pull-tab.

The key to the seal is the fact that the platform 12 forms a seal with the upper lip. The size and shape of the platform 12 can vary to achieve a tight seal. In FIG. 5, the pull-tab area 13 extends completely across the lid 10 with the exception of two projections 17*a* and 17*b* which extend upward on opposite sides of the aperture 14.

Figure 7:
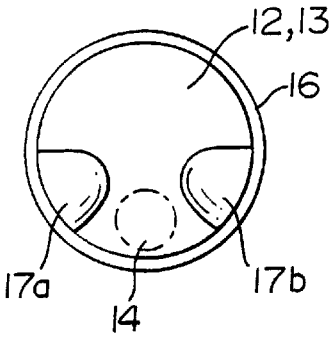
FIG. 7 is a top view of an alternate embodiment of the invention with the raised portions at a different level from the platform.
Figure 8:
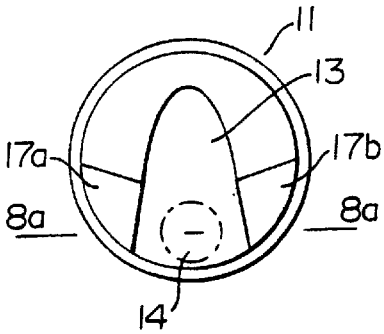
FIG. 8 is a top view of an alternate embodiment of the invention showing a slope leading outwardly from the pull-tab area to the raised platform.
Figure 8A:
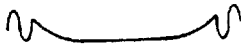
FIG. 8*a* is a cross-sectional view taken along the line 8*a*—8*a* of FIG. 8.

The size and shape of the projections 17*a* and 17*b* can vary to achieve a tight seal as shown in FIGS. 1–7. In FIG. 6, the projections 17*a* and 17*b* are at a different level from the raised platform 13. In FIG. 7, the raised platform 13 and pull tab area 12 are combined together with groove 16 while in FIG. 6 the platform 13 and area 12 are not combined together and connected with groove 16.

FIGS. 9, 10 and 11*a*–11*f* depict a can lid 30 of the prior art with a peripheral groove 31, a raised platform 32 and a pull-tab recess 33 with the aperture 34. FIGS. 11*a*–11*f* show various cross-sectional views taken along the lines indicted in FIG. 10, which is the lid 30 of FIG. 9.

In FIGS. 11*a*–11*f*, groove 31 is the lowest point on the lid 30, platform 32 is essentially a flat surface and recess 33 is slightly below platform 32 to protect and define the opening hole area. Recess 33 does not, however, protect the pull-tab completely.

FIGS. 12*a–f* depicts a new and improved lid 40 with cross sectional views corresponding to the views 11*a*11*f* of FIG. 10*a–f*. The groove 41 is the same as in FIG. 10*a–f* but is not necessarily the lowest point. Platform 42 has an overall slope from the front side (opening hole side) moving upward toward the backside (pull tab side) as shown in FIGS. 11*d* and 11*f*. The slope can be a straight or curved line. The object is to raise the height of platform 42 in the area of FIG. 11*c* and 12*c* high enough to reduce the leaking problem when drinking.

The slope in FIGS. 11*d* and 11*f* can also start from the backside and go upward towards the front side. The aforementioned slopes can also be a dome shape with the platform area 32 in FIG. 11*c* high enough to reduce leakage.

In FIGS. 12*d* and 12*f*, the pull-tab recess area 43 is substantially lower than the highest point of platform 42. The recess 43 must be low enough to protect the pull-tab from being lifted off accidentally. For example, the platform 32 in FIG. 11*a–f* showing an existing lid 30 cannot be too high otherwise the pull-tab will be exposed above the rim and may be opened unexpectedly.

Figure 13A:
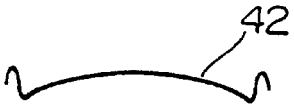
FIG. 13*a* and 13*b* disclose a variation on the section view appearing in FIG. 12*d* and 12*f* wherein the platform is sloped and in FIG. 13*a* is dome-shaped.
Figure 13B:
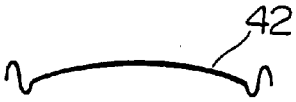

Based on the foregoing "substantially lower" definition platform 42 can be located at a height close to the rim height with a shape similar to FIG. 13. The recess 43 is low enough to protect the pull-tab. Notably, none of the existing lid designs shows a version of the pull-tab, which is protected in the recess area 43. In the current designs, the recess area 33 is only for the protection and definition of the opening hole.

Figure 14A:
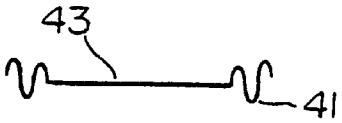
FIG. 14 discloses alternate embodiments of the invention from a cutaway side view of 11*e;*
Figure 14B:
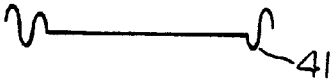
Figure 14C:
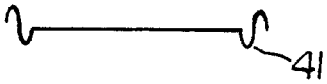
Figure 14D:
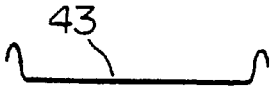
Figure 14E:
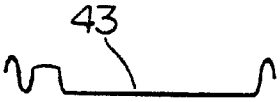

Recess 43 can be any of the following designs shown in FIGS. 14*a*–14*d*. For example FIG. 14*a* depicts a recess 43 and FIG. 14*b* shows a recess in the center platform 42 connecting with the groove 41 on the front side. In FIG. 14*c*, a recess in the center platform 42 connects with the groove 41 on both front and backsides. FIG. 14*d*, illustrates a recess in the center platform 42 at a level equal to or lower than the groove 41 and connecting with groove 41 on front and back sides. In FIG. 14*e*, a recess is located in the center platform 42, at a level equal to or lower than the groove 41 and connecting with the groove 41 on the front side only.

The lid 40 in FIG. 12*d–f* shows a gentle slope, which permits the lid 40 to be slanted up easier and facilitates the feeding of lids 40 on the production line.

Figure 15:
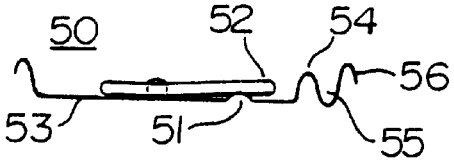
FIGS. 15 and 17 disclose alternate embodiments of the invention in a cutaway side view.
Figure 17:
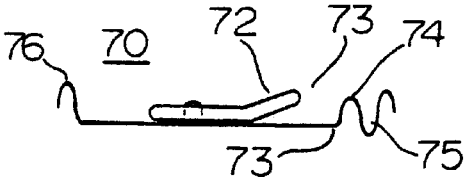

In a further embodiment of the invention shown in FIG. 15, a bump 51 is located on the lid 50 to lift up pull-tab 52 for ease of opening. This is possible since the pull-tab recess 53 is substantially lower than the raised platform 54. The groove 55 and rim 56 are also depicted in FIG. 15 and 17. In 7 the prior art, the pull-tab recess 53 is generally too shallow with regard to the platform 54 to permit such a design. In this embodiment as well as the others described herein, the pull-tab 42 may be plastic.

Figure 16:
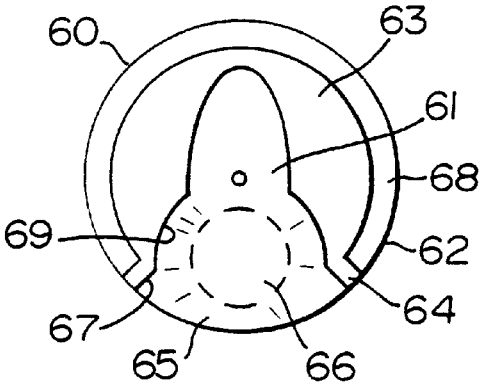
FIG. 16 discloses another alternate embodiment of the invention from a top view.

A design 60, which is drip-proof, leaves no residue during drinking and is easy to clean is shown in FIG. 16. Recess 61 is connected to the rim 62 and is slightly lower, equal to or higher than groove 68. Platform 63 is joined to the rim 62 by wall 64, which is slightly lower, equal to or higher than platform 63 but higher than recess 61 and groove 68. Wall 64 acts as a blocker to prevent liquid from flowing into groove 68.

Further, radius 65 drops down from rim 62 to opening spout 66. Similar radius 67 and 69 also drop from wall 64 and platform 63 to spout 66. This arrangement forms a funnel effect which drains back all of the liquid after drinking or pouring. This is important since it reduces the chance of product going over the wall 64 into the groove 68 and it maintains the area near the spout 66 free of liquid. The design creates a neat lid 60 instead of a messy looking top 30. A neat top 60 helps to reduce the dripping problem. The radii 65, 67 and 69 present a smooth surface, which can be wiped clean by finger or other means.

In a still further embodiment shown in FIG. 17, the tab 71 on lid 70 is bend upward a, 72 to keep the tab end 73 lower than platform 74. The tab 71 is easier to open with end 73 providing a lever. Groove 75 and rim 76 also are shown in FIG. 11–17.

Figure 18:
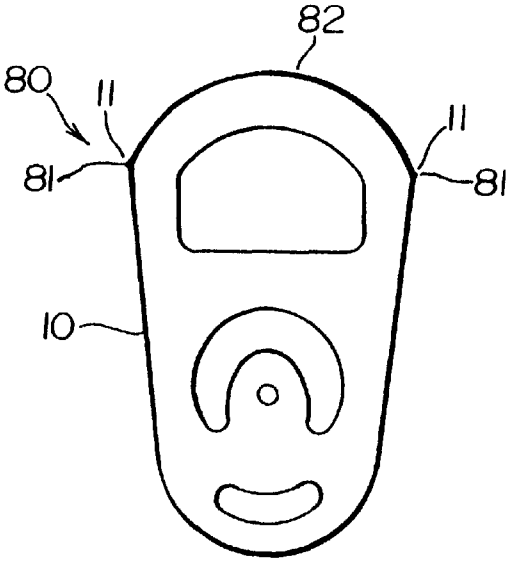
FIG. 18 is a top view of a conventional pull-tab.

Current metal pull-tabs 80 as shown in FIG. 18 have the following problems. Firstly, the fold over edges of aluminum pull-tab 80 have sharp corners 81 which can hurt fingers. Secondly, the pull-tab recess 13 on the lid 10 is very shallow (to the center platform 12). The pull-tab 80 is designed with a flat shape to keep its profile low for production purposes. This shape, however, makes the pull-tab difficult to open.

Figure 20A:
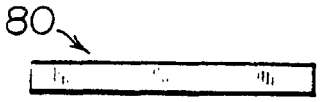
FIG.20a (PRIOR ART)
FIGS. 20*a* and 20*b* are respectively schematic views of the body side and handle side of FIG. 18.
Figure 20B:
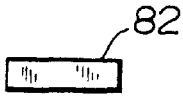
Figure 21A:
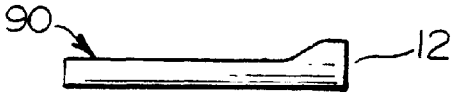
FIGS. 21*a* and 21*b* are respectively a body side view and a handle side view of FIGS. 19*a* and 19*b;*
Figure 21B:
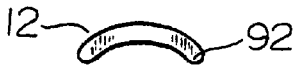
Figure 22A:
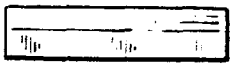
FIGS. 22*a* and 22*b* are another embodiment of a body side view and a handle side view of FIGS. 19*a* and 19*b*; and, FIGS. 23*a* and 23*b* are embodiments of side view and front view of a special puncture tip of a new pull-tab.
Figure 22B:
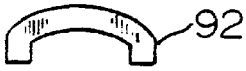

The new pull-tab 90 shown in FIG. 19 drops the pull-tab area 13 lower so that there is more room to design a new and more comfortable pull-tab 90. FIGS. 20*a* and 20*b* depict respectively the body side view of the prior art pull-tab 80 and a side view of the handle 82. FIGS. 21*a* and 21*b* depict respectively a body side view of the new tab 90 and the arch handle 92 in a side view. FIGS. 22*a* and 22*b* depict respectively a n arch body side view of the new tab 90 and the arch handle 92 in a side view.

Figure 19B:
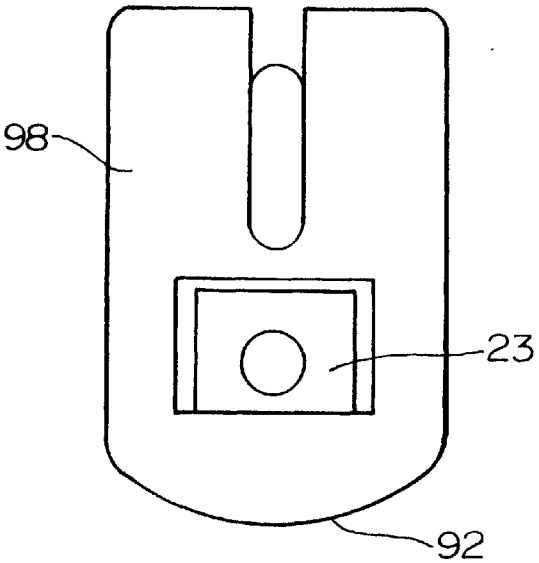
FIGS. 19*a* and 19*b* are respectively a top view and a bottom view of a new pull-tab.
Figure 19A:
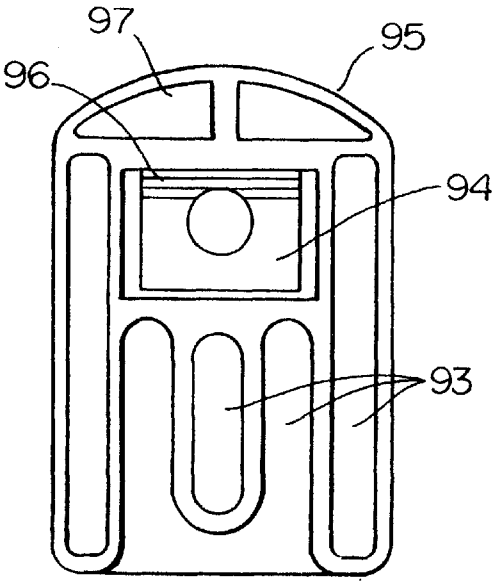

To eliminate the sharp comers 81 and raw edges of metal pull tabs 80, a plastic pull-tab 90 is illustrated in FIG. 19*a* and 19*b*, which is a top view of FIG. 19*a*. This new plastic pull-tab 90 includes an arch handle 92 for ease of opening with the arch design extending all the way to the front. The arch shape is stronger than a flat shape and requires thinner material resulting in a cost savings. The pull-tab 90 includes reinforcing ribs 93 on the underside to increase strength and reduce material needed. The pull-tab 90 also includes a strip 94 for riveting onto the lid. Strip 94 is connected with the front end 95 with a flexible hinge 96. The reinforcements 97 increase the front strength.

As a further advantage, plastic pull-tabs 90 can be molded in various colors to customize the look of the beverage can. The top panel 98 is a display panel for various designs such as a logo.

Figure 23A:
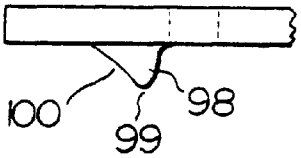
Figure 23B:
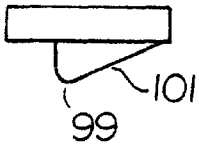

In another embodiment of reinforcements 97, FIGS. 23*a* depicts a body side view of the new design puncture tip 98 and FIG. 23B depicts a front side view of puncture tip 98. The lower point 99 is located directly over the initial break point of the scored line around the apertures. By reducing the distance from 99 to the rivet, we can reduce the force required to lift the handle. The slopes 100 and 101 guide the contact point of tip 98 with the aperture cover to follow the break edge all the way to complete open.

While the invention has been explained by a detailed description of certain specific embodiments, it is understood that various modifications and substitutions can be made in any of them within the scope of the appended claims, which are intended also to include equivalents of such embodiments.

What is claimed is:

1. A sanitary drinking container having a lid, which prevents spillage by forming a seal with one's upper lip comprising:

an outer peripheral rim;

walls having a first wall portion extending downwardly from the rim for a predetermined distance and then having a second wall portion extending upwardly from the first wall portion;

a first and a second raised platform portion each having one end spaced from the rim at the upwardly extending wall and said platform portions being spaced from each other;

a groove formed between the rim and the raised platform portion by the first wall portion and the second wall portion and extending partially about the rim;

a pull tab area having an aperture positioned thereon and extending between the first and second raised platform portions completely across the lid; said area being at substantially the same level as the groove; and, said platform portions having sloped walls extending downwardly to the pull-tab area and upward projections on the raised platform portions capable of forming a seal with one's upper lip to prevent spillage.

2. A sanitary drinking container having a lid, which prevents spillage by forming a seal with one's upper lip in accordance with claim 1 wherein:

the pull-tab area and raised platform are on the same level and two protrusions extend upwardly on opposite sides of the aperture.

3. A sanitary drinking container having a lid, which prevents spillage by forming a seal with one's upper lip in accordance with claim 1 wherein:

the raised platform includes a curved surface extending upwardly from one end.

4. A sanitary drinking container having a lid, which prevents spillage by forming a seal with one's upper lip in accordance with claim 1 further including:

a plastic pull-tab including plurality of elongated spaced ribs to increase strength;

forward tab portion including a strip for riveting to the lid; and, a hinge connecting the strip to the tab portion.

5. A pull-tab for a sanitary drinking container having a lid with a scored aperture thereon in accordance with claim 1:

wherein the pull-tab is plastic.

6. A pull-tab for a sanitary drinking container having a lid with a scored aperture thereon in accordance with claim 5:

wherein the front portion having projecting reinforcements is skewed to one side of the lid.

7. A pull-tab for a sanitary drinking container having a lid with a scored aperture thereon in accordance with claim 5;

wherein the front portion having projecting reinforcements include a tip to puncture the scored aperture first and follow the score line to continue the opening action of the aperture hole.

8. A sanitary drinking container having a lid, which prevents spillage by forming a seal with one's upper lip comprising:

an outer peripheral rim;

an outer wall extending downwardly from the entire rim for a predetermined distance and having a lower portion at the end of said distance;

an inner wall extending partially about the rim at a spaced distance from the outer wall and being joined to the lower portion of the outer wall and extending upwardly therefrom;

said outer and inner walls defining a groove therebetween, said groove extending partially about the rim;

a raised platform portion having an end spaced from the rim at the upwardly extending inner wail and an inner end and having a substantially V-shaped configuration, including opposing legs;

a pull tab area having an aperture positioned thereon and extending between the V-shaped raised platform legs to the groove, said area being at substantially the same level as the groove; and, said raised platform portion having sloped walls at the inner end extending downwardly to the pull tab area and upward projections on each of the raised platform legs forming a seal with one's upper lip to prevent spillage.

9. A sanitary drinking container having a lid, which prevents spillage by forming a seal with one's upper lip in accordance with claim 8 wherein:

the groove extends completely around the periphery of the lid.

10. A sanitary drinking container having a lid, which prevents spillage by forming a seal with one's upper lip in accordance with claim 8 wherein:

the raised platform ranges from slightly higher than the groove depth to slightly higher than the rim.

11. A sanitary drinking container having a lid, which prevents spillage by forming a seal with one's upper lip comprising:

an outer peripheral rim;

walls extending downwardly at one end from the rim for a predetermined distance and then upwardly at the other end;

a groove formed between said walls;

a raised platform joined to said upwardly extending walls;

a pull tab recess extending from said raised platform at a lower height;

a bump extending upwardly from said pull tab recess; and, a pull-tab mounted on said pull tab recess and having one end at an upwardly angle engaging the bump and extending outwardly therefrom to facilitate gasping the tab to open the container.

12. A pull-tab for a sanitary drinking container having a lid with a scored aperture thereon comprising:

a front portion having projecting reinforcements, a recess and a strip mounted therein said strip being riveted to the lid over the aperture;

spaced elongated ribs extending along the tab from the font portion to provide strength to the tab;

a flexible hinge mounted to the front portion at one end and to the strip at the other end; and, said tab including an arch handle comprising a raised upper surface and having a recess on the bottom surface thereof to facilitate gripping the tab.

13. A sanitary drinking container having a lid, which prevents spillage by forming a seal with one's upper lip comprising:

an outer peripheral rim;

walls having a first wall portion extending downwardly from the rim for a predetermined distance and then having a second wall portion extending upwardly from the first wall portion;

a first and a second raised platform portion each having one end spaced from the rim at the upwardly extending wall and said platform portions being spaced from each other;

a groove formed between the rim and the raised platform portion by the first wall portion and the second wall portion and extending partially about the rim;

a pull tab area having an aperture positioned thereon, said area being at substantially the same level as the raised platform portions and spaced therebetween; and, said platform portions having upward projections on the raised platform portions forming a seal with one's upper lip to prevent spillage.

* * * * *